US005349972A

United States Patent [19]

Dirksing et al.

[11] Patent Number: 5,349,972

[45] Date of Patent: Sep. 27, 1994

[54] DUAL WIPER MASCARA PACKAGE HAVING RESIDUAL CHAMBER WITH BYPASS CHANNEL

[75] Inventors: Robert S. Dirksing; David T. Miller, both of Cincinnati, Ohio

[73] Assignee: The Procter & Gamble Company, Cincinnati, Ohio

[21] Appl. No.: 993,285

[22] Filed: Dec. 18, 1992

[51] Int. Cl.[5] ..... A45D 40/26

[52] U.S. Cl. ..... 132/218; 132/320; 401/122

[58] Field of Search ..... 132/216, 218, 320; 401/15, 121, 122, 129

[56] References Cited

U.S. PATENT DOCUMENTS

| | | | |
|---|---|---|---|
| 3,010,138 | 11/1961 | Nadai | 401/15 |
| 3,214,782 | 11/1965 | Masters et al. | 401/122 |
| 3,469,928 | 9/1969 | Widegren | 401/128 |
| 3,471,244 | 10/1969 | Melocchi | 401/122 |
| 3,957,066 | 5/1976 | Dahm | 132/88.7 |
| 4,403,624 | 9/1983 | Montgomery | 132/218 |
| 4,470,425 | 9/1984 | Gueret | 132/88.5 |
| 4,627,454 | 12/1986 | Dahm | 132/88.7 |
| 4,628,950 | 12/1986 | Bitzer | 132/218 |
| 4,671,689 | 6/1987 | Gueret | 401/122 |
| 4,687,364 | 8/1987 | Kingsford | 132/218 |
| 4,886,387 | 12/1989 | Goldberg et al. | 132/320 |
| 5,086,793 | 2/1992 | Kingsford | 132/218 |

FOREIGN PATENT DOCUMENTS

| | | | |
|---|---|---|---|
| 0002301 | 6/1979 | European Pat. Off. | 401/122 |
| 2722232 | 11/1978 | Fed. Rep. of Germany | 401/122 |
| 612089 | 11/1960 | Italy | 401/122 |

*Primary Examiner*—Gene Mancene
*Assistant Examiner*—Frank A. LaViola
*Attorney, Agent, or Firm*—Michael E. Hilton; John M. Howell; Steven J. Goldstein

[57] ABSTRACT

A cosmetic product package, particularly a mascara package, including a dual wiper mechanism which virtually eliminates the messiness problems of typical mascara applicators. The dual wiper mechanism has a resilient inner wiper and a resilient outer wiper spaced apart from one another within a supporting structure forming a residual mascara chamber therebetween. The inner wiper has a relatively small opening which provides most of the doctoring of the bristles. The outer wiper has a larger opening which primarily doctors the stem. Mascara which collects in the residual chamber flows through conduits around the inner wiper back into the primary reservoir, or alternatively to a discard reservoir. A mechanism to doctor more mascara from the brush upon insertion than upon removal of the brush may also be provided.

17 Claims, 5 Drawing Sheets

DUAL WIPER MASCARA PACKAGE HAVING RESIDUAL CHAMBER WITH BYPASS CHANNEL

BACKGROUND OF THE INVENTION

1. Field of the Invention

The present invention relates to packages for cosmetic products; and more particularly, to such packages having an applicator which is utilized for application of the cosmetic product; and specifically, to such packages which include two wipers which act on the applicator.

2. Description of the Prior Art

Typical commercial mascara packages include a small elongated cylindrical bottle containing a quantity of mascara and a brush which includes a cap for the bottle. The cap also operates as a handle for the brush. The brush typically comprehends a stem extending from the interior of the cap which has a plastic portion and a twisted wire portion which supports the bristles. The twisted wire portion generally has a small diameter relative to the plastic portion. The bottle generally includes a wiper installed within the neck of the bottle. The wiper has a centrally located opening having a diameter of about the diameter of the larger plastic portion of the stem. The wiper is intended to remove all mascara from the stem and any excess mascara from the ends of the bristles.

Although such packages are relatively inexpensive to manufacture, they are generally messy to use. For example, a common problem experienced by users of current mascara packages is known as "tailing" wherein a tail of mascara is left on the distal end of the brush stem. Since the opening in the wiper is generally sized to the diameter of the plastic portion of the stem, the wiper does not engaged the "tail" of mascara which may extend from the distal end of the brush as it exits through the wiper. Thus, a small blob of mascara is left at the end of the brush. This small blob of mascara has a tendency to relocate on the skin about the eyes of the user. Many mascara users have learned to wipe the end of the brush on the mascara bottle above the wiper. Unfortunately, when the brush is reinserted into the package this blob is spread up the stem by the wiper, resulting in an even messier situation.

This problem has been recognized for some time and rather complex remedies have been proposed. For example, U.S. Pat. No. 2,990,834 issued to Amen on Jul. 4, 1961 discloses a valve element that is spring loaded against the end of the brush so that as the brush is retracted, the valve element is held securely against the trailing end of the brush. As the end of the brush exits the wiper, the valve element prevents the attachment of a "tail" so the brush stem has a clean tip. Unfortunately, the valve element and spring add considerable mechanical complexity and cost to the package.

Another disadvantage of typical commercial mascara packages is their inability to wipe mascara from the core of the bristle pattern. This also limits the sizes and shapes of bristle patterns which may advantageously be used with such packages. Since the opening in the wiper generally matches the diameter of the plastic portion of the stem, the core of the bristle pattern extending about the twisted wire is not wiped by the wiper. The mascara left near the bristle core tends to remain there during repeated removals and insertions of the brush from and into the container. The mascara near the core tends to dry out and may subsequently be deposited on the eyelashes of the user as dry chunks which can cause flaking and smudging.

U.S. Pat. No. 4,403,624 issued to Montgomery on Sep. 13, 1983 enables wiping near the core of the bristle pattern by enlarging the diameter of a portion of the stem which supports the bristles. An inner wiper having an opening with a diameter about the size of the diameter of the stem supporting some of the bristles provides most of the wiping action. An outer wiper having an opening significantly larger than the diameter of the largest stem portion helps prevent splattering of the mascara as the brush is withdrawn and provides some minimal wiping action. Unfortunately, this package does not solve the tailing problem. Furthermore, mascara can be driven up the stem, since mascara wiped from the inner wiper as the brush is reinserted has no other place to go and can readily pass through the large opening of the outer wiper.

U.S. Pat. No. 4,886,387 issued to Goldberg et al. on Dec. 12, 1989 discloses a mascara container having an upper wiper element near the open end of the mascara container and a lower wiper element located near the lower end of the container. The lower wiper element serves to divide the container into two chambers. The lower wiper has a relatively small opening to wipe the bristles near the core prior to charging the brush with mascara. Once the bristles are pulled through the lower wiper the brush is charged by swirling and/or pivoting the brush in order for the brush to contact the mascara which is somehow filled in a coaxial fashion within the container and about the brush. The upper wiper element removes any excess mascara from the ends of the bristles as the brush is removed from the package and wipes the surface of the supporting red clean as the rod is withdrawn. Here again a rather expensive and complex packaging system is disclosed. Furthermore, this package apparently does not deal with the tailing problem and the problem of mascara being driven up the stem.

SUMMARY OF THE INVENTION

In accordance with one aspect of the present invention a cosmetic product package is provided which includes a container and a applicator. The container has a plurality of walls connected so as to house the cosmetic product. The container also includes an opening in one of the walls providing communication with the cosmetic product housed within the container. The applicator includes a stem having a means for grasping the applicator at the proximal end of the stem and a means for applying the cosmetic product at the distal end of the stem. The package further includes a dual wiper mechanism located within the opening of the container. The dual wiper mechanism includes a primary wiper element having an opening therein. The opening preferably has a diameter sufficiently small that no significant tail is left on the end of the stem as the applicator is removed from the container. Preferably the diameter of the opening in the primary wiper element is less than about the diameter of the distal end of the stem. A secondary outer wiper element having an opening therein is also part of the dual wiper mechanism. The secondary wiper provides wiping of the stem. Additionally, dual wiper mechanism includes a housing which locates the primary wiper element within the opening of the container and secondary wiper element within the opening of the container exteriorly of the primary wiper element and spaced from the primary wiper element forming a residual product reservoir between the primary wiper element and the secondary wiper element. The housing has a channel providing fluid communication from the residual product reservoir around the primary wiper element. The container may also include a separate discard reservoir and the housing may include a channel providing fluid communication between the residual product reservoir and the discard reservoir.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and wherein;

DESCRIPTION OF THE PREFERRED EMBODIMENT

Figure 1:
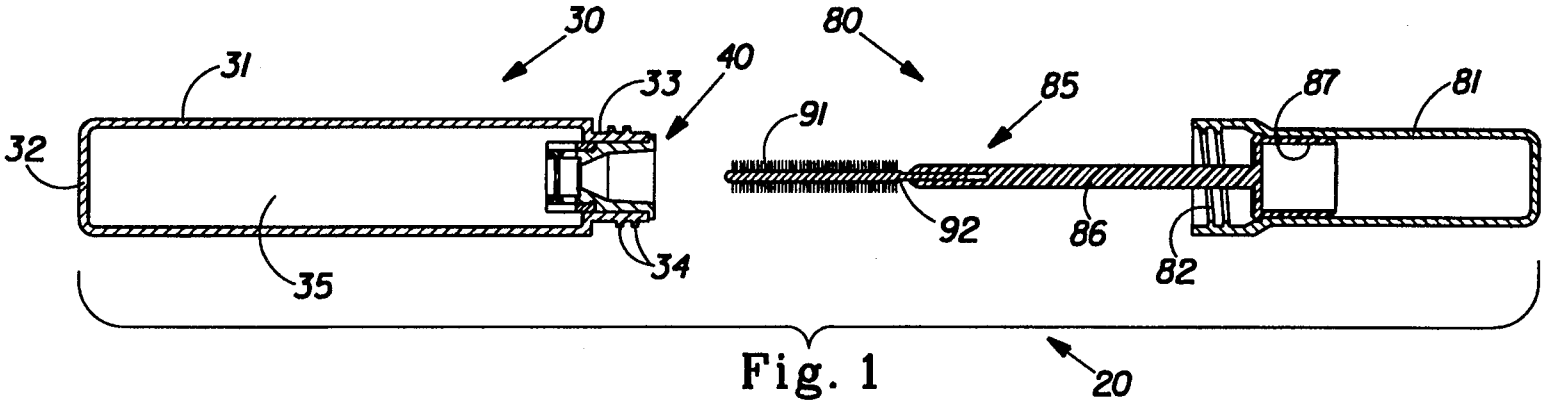
FIG. 1 is a cross-sectional view of a preferred mascara package with the brush portion detached from the bottle portion.

In a preferred embodiment shown in FIG. 1, the present invention provides a cosmetic product package, generally designated 20. Although the terms "cosmetic product" and "mascara" are used throughout, this package may be advantageously used with a variety of products and this language is not meant to be limiting. The cosmetic product package 20 includes bottle portion 30 and brush portion 80. Brush portion 80 includes overcap 81 and stem 85. Overcap 81 is provided with internal threads 82. Stem 85 comprehends plastic portion 86, and twisted wire portion 92 which supports bristles 91. As in this embodiment, the diameter of twisted wire portion 92 is typically small relative to the diameter of plastic portion 86. Twisted wire portion 92 is permanently fastened to plastic stem portion 86. Bristles 91 extend from twisted wire portion 92 of stem 85. Stem 85 is cantilevered from and integrally molded with plug 87 which is permanently fastened to overcap 81 by adhesive, snap-fit or other suitable means.

Figure 3:
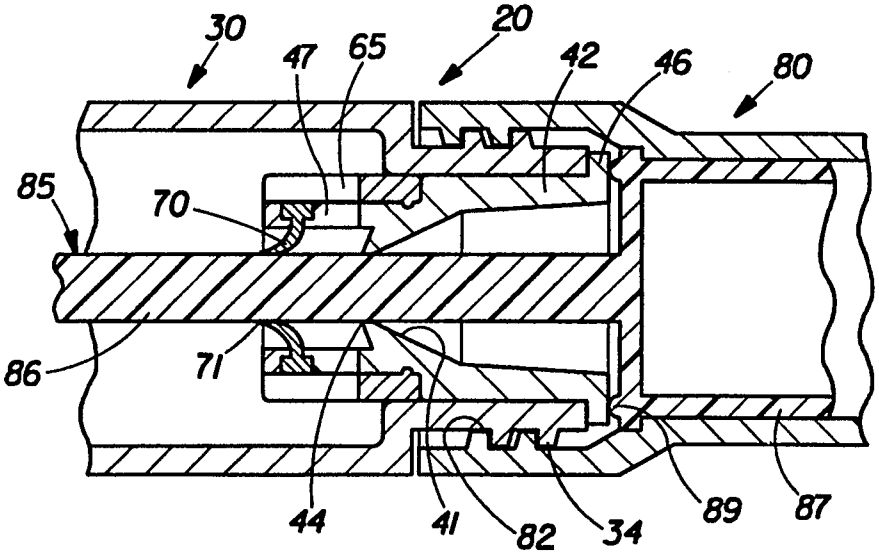
FIG. 3 is an enlarged fragmentary cross-sectional view similar to FIG. 2 with brush portion attached to the bottle portion.

Bottle portion 30 includes bottle 31 and dual wiper mechanism 40. Bottle 31 is generally cylindrical in form and has a closed end 32 and an open end opposite thereto at neck 33. Neck 33 is provided with external threads 34 which are engageable with internal threads 82 on overcap 81 to releasably secure brush portion 80 to bottle 31, as seen in FIG. 3. The interior of bottle 31 forms primary product reservoir 35 for housing the cosmetic product.

Figure 2:
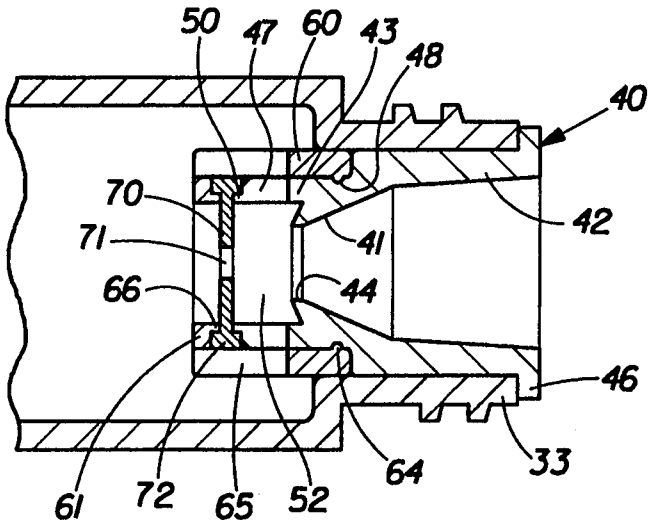
FIG. 2 is an enlarged fragmentary cross-sectional view of the preferred mascara package in FIG. 1 illustrating the dual wiper mechanism.

Referring to FIG. 2, the dual wiper mechanism 40 includes housing 42, primary wiper 70, and primary wiper retainer 60. Secondary wiper 41 extends from, and is integrally molded with housing 42. Secondary wiper 41 includes a centrally located opening 44 having a diameter about the diameter of the plastic portion 86 of stem 85. Housing 42 includes a inwardly extending cylindrical portion 43 below the secondary wiper 41 which terminates in an annular bead 50. The cylindrical portion 43 includes several radially spaced slots 47.

Primary wiper 70 includes centrally located opening 71. The diameter of opening 71 of this embodiment is about equal to the diameter of twisted wire portion 92 of the stem 85. Primary wiper 70 is made of a resilient material such as a silicone elastomer. Preferably the material of primary wiper 70 has a hardness of between about 40 Shore A and about 100 Shore A.

Primary wiper retainer 60 is a generally cylindrical unitary molded part including inner flange 61 which has an outwardly directed annular bead 66. In addition, primary wiper retainer 60 includes several radial slots 65 spaced to match slots 47 of cylindrical portion 43. Lock bead 64 of primary wiper retainer 60 snaps into groove 48 of housing 42, thereby fastening primary wiper retainer 60 onto housing 42. Upon fastening primary wiper retainer 60 to housing 42, annular bead 50 of cylindrical portion 43 of housing 42 and annular bead 66 of inner flange 61 of wiper retainer 60 confine thickened peripheral annular portion 72 of the primary wiper 70 to secure the periphery of primary wiper 70.

Once fastened, the inner surface of secondary wiper 41, the outer surface of primary wiper 70, and the interior of cylindrical portion 43 form residual product reservoir 52. Primary wiper retainer 60 is interrupted by slots 65 which align with slots 47 of cylindrical portion 43 to provide channels which communicate between residual mascara reservoir 52 and primary product reservoir 35.

Once assembled, dual wiper mechanism 40 is permanently inserted into neck 33 until flange 46 of housing 42 engages the face of neck 33 and limits the introduction of secondary wiper 41 into neck 33. Dual wiper mechanism 40 may be permanently held in place, for example, by utilizing a friction fit, a snap fit and/or adhesive between the outer surface of housing 42 and the inner surface of neck 33.

Referring to FIG. 3, brush portion 80 is secured to bottle portion 30 by means of screws threads 82 and 34, respectively. Plastic stem portion 86 is shown penetrating opening 44 in secondary wiper 41 and opening 71 in primary wiper 70. Primary wiper 70 is shown deflected inwardly and elastically distended about plastic stem portion 86. This is due to the fact that opening 71 in primary wiper 70 is smaller in diameter than the diameter of the plastic portion 86 of stem 85. Bead 89 of plug 87 engages the outer surface of flange 46, thereby further sealing cosmetic product package 20.

Figure 4:
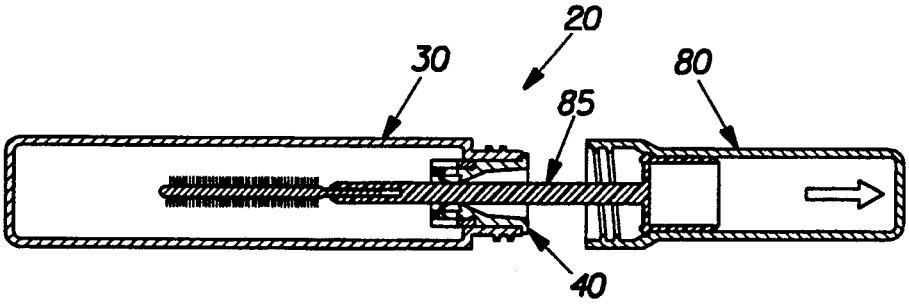
FIG. 4 is a cross-sectional view of the mascara package of FIG. 1 with the brush portion partially withdrawn from the bottle portion.
Figure 5:
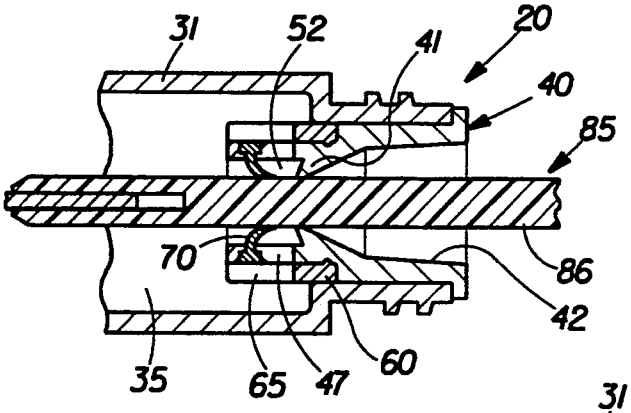
FIG. 5 is an enlarged fragmentary cross-sectional view of the mascara package of FIG. 1 with the brush portion partially withdrawn from the bottle.

Referring to FIG. 4 and FIG. 5, brush portion 80 is being withdrawn from bottle portion 30 in the direction indicated by the arrow. Primary wiper 70 is shown deflected outwardly in response to the outward movement of stem 85. Mascara (not shown) in primary product reservoir 35 that adheres to outgoing stem 85 is wiped clean by primary wiper 70. Any residual mascara that may have been in residual product reservoir 52 is wiped by secondary wiper 41. The channels formed by slots 47 and 65 provide an outlet for residual mascara retained in residual product reservoir 52 in order to accommodate the displacement of volume within residual product reservoir 52 as primary wiper 70 is deflected, thereby reducing the volume of residual product reservoir 52.

Figure 6:
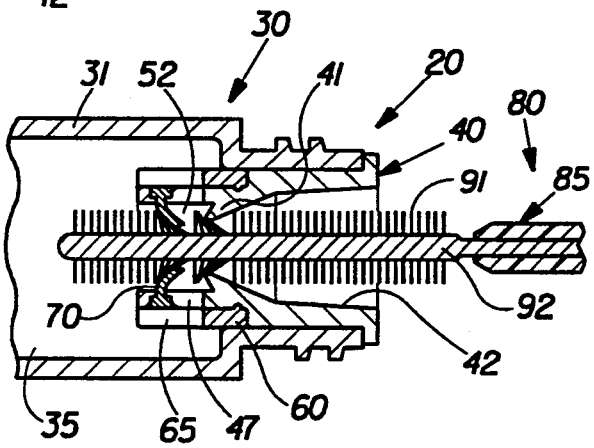
FIG. 6 is an enlarged fragmentary cross-sectional view generally similar to that of FIG. 5 but having the brush portion further withdrawn from the bottle portion so that the bristles are within the dual wiper mechanism.

Referring to FIG. 6, the package 20 is illustrated with twisted wire 92 and bristles 91 within dual wiper mechanism 40. The primary purpose of the dual wiper mechanism 40 is to ensure an appropriate quantity of mascara is applied to the bristles 91 of the brush portion 80. In addition to providing this basic requirement, the dual wiper mechanism 40 further provides a clean stem 85 and virtually no tail on the brush portion 80. Excess mascara (not shown) from primary reservoir 35 is squeegeed from bristles 91 by primary wiper 70. Little additional wiping action occurs at secondary wiper 41.

Figure 7:
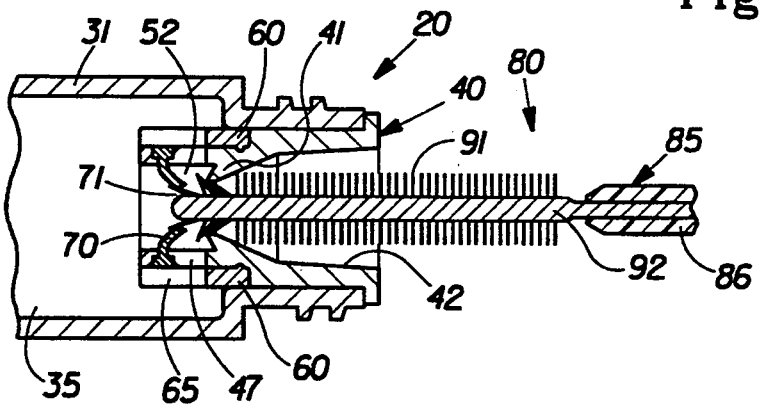
FIG. 7 is an enlarged cross-sectional view generally similar to that of FIG. 6 but having the cap portion still further withdrawn from the bottle portion so that the bristles are about to exit the dual wiper mechanism.

Referring to FIG. 7, the package 20 is illustrated with the brush portion 80 about to exit primary wiper 70. The small opening 71 of primary wiper 70, as it approaches its relaxed condition, cause primary wiper 70 to close about the trailing end of brush portion 80, thereby removing virtually all the tailing mascara that tends to adhere to the outgoing brush portion 80 end. Thus, the diameter of the opening 71 in the primary wiper 70 is sufficiently small that no significant tail of mascara remains on the stem 85 as it is removed from the primary wiper 70. A tail is "significant" if it falls off brush portion 80, or otherwise negatively contacts the consumer during the normal process of applying mascara. Preferably, the diameter of opening 71 is about the same or less than the diameter of twisted wire 92 (i.e., distal end of stem 85).

Furthermore, dual wiper mechanism 40 of the present invention enables the use of non-standard brush shapes. For example, bristles 91 of this embodiment extend radially in all directions from twisted wire portion 92 of stem 85 so that the bristles 91, in aggregate, provide a circular cross-section. The diameter of the cross-section created by bristles 91 is about equal to the diameter of plastic portion 86 of stem 92. This diameter is significantly smaller than typical mascara packages, allowing greater control during application. Another example, illustrated in FIGS. 14 and 15, has bristles 291 and 391, respectively, which extend mostly in one direction while the opposing side of the supporting twisted wire 292 and 392, respectively, is void of all bristles. Other variations (not seen) of brush design, such as a brush having bristles extending in four directions only (i.e., such that the aggregate bristle cross-section forms an "X") are practical with the dual wiper mechanism 40 of the present invention.

Figure 8:
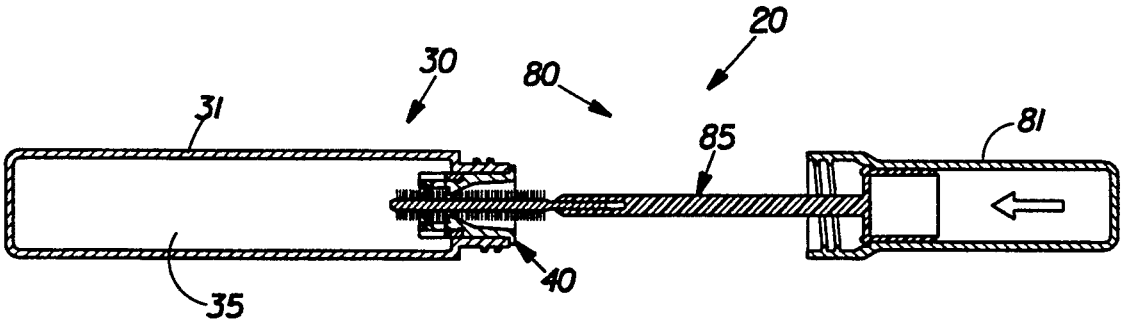
FIG. 8 is a cross-sectional view of the mascara package of FIG. 1 with the brush portion partially inserted into bottle portion.
Figure 9:
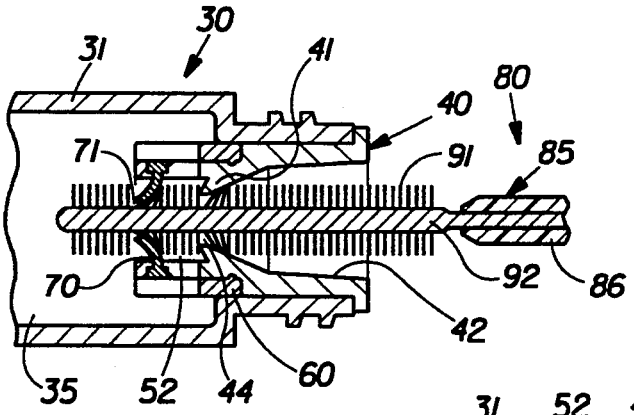
FIG. 9 is an enlarged fragmentary cross-sectional view of a dual wiper mechanism of the mascara package in FIG. 1, with the bristles partially inserted through the dual wiper mechanism.

Referring to FIGS. 8 and 9, subsequent to applying mascara to the eyelashes using brush portion 80, the user of mascara package 20 reinserts stem 85 of brush portion 80 back into bottle portion 30, either in preparation for closure and storage or in preparation for further mascara application. Although bristles 91 of brush portion 80 may encounter some minor wiping action as bristles 91 pass through opening 44 of secondary wiper 41, the smaller opening 71 in primary wiper 70 effects considerably more constriction and thus, wiping of bristles 91 of brush portion 80. In fact, the shape and size of secondary wiper 41 are preferably such that virtually no significant wiping action occurs upon reinsertion of the bristles 91 and stem 85 of brush portion 90. Thus, mascara will not build up on the stem 85, outboard of the secondary wiper 41. While the constricting effect of primary wiper 70 on the outgoing bristles 91 and stem 85 of brush portion 80 during withdrawal in preparation for use causes excess product to be squeegeed from bristles 91 and stem 85 of brush portion 80 on the inboard side of primary wiper 70, the reintroduction of bristles 91 and stem 85 of brush portion 80 back into bottle portion 30 causes primary wiper 70 to squeegee residual mascara from bristles 91 and stem 85 of brush portion 80 on the outboard side of primary wiper 70. This residual mascara accumulates in residual product reservoir 52 as the length of the stem 85 of brush portion 80 passes through primary wiper 70.

Figure 10:
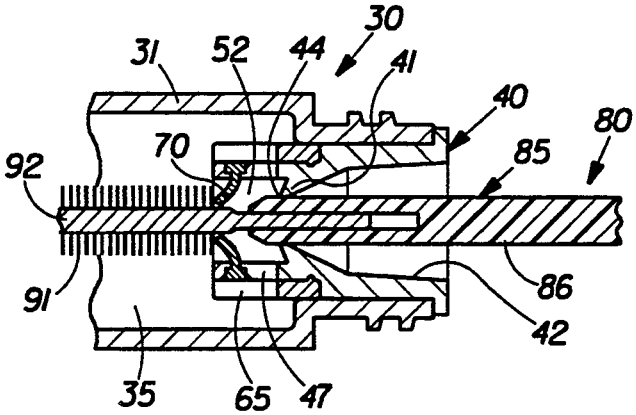
FIG. 10 is an enlarged fragmentary cross-sectional view generally similar to that of FIG. 9 but having the brush portion further inserted into the bottle portion with the stem partially inserted into the dual wiper mechanism.

Referring to FIG. 10, most of bristles 91 of brush portion 80 are shown as having passed through primary wiper 70. The distal end of plastic portion 86 of stem 85 is shown having just entered opening 44 of secondary wiper 41. Opening 44 of secondary wiper 41 seals about the shaft of plastic portion 86 of stem 85. Further introduction of plastic portion 86 of stem 85 into residual product reservoir 52 causes the accumulated residual mascara to be displaced by the stem 85 and forced through the channels formed by slots 47 and 65 back into primary product reservoir 35.

Figure 11:
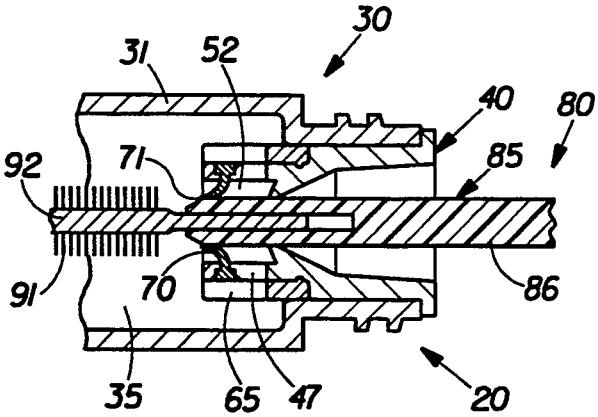
FIG. 11 is an enlarged fragmentary cross-sectional view generally similar to that of FIG. 10 but having the brush portion still further into the bottle portion with the stem further inserted through the dual wiper mechanism.

FIG. 11 is an enlarged cross-sectional view similar to FIG. 10 but having stem 85 still further penetrating dual wiper mechanism 40 such that the leading end of plastic portion 86 of stem 85 is seen having just passed through opening 71 in primary wiper 70. Primary wiper 70 is deflected inwardly and stretched to accommodate the diameter of plastic portion 86 of stem 85. From the condition seen in FIG. 11, brush portion 80 will be further inserted into bottle portion 30 by the user to either recharge bristles 91 of brush portion 80 with additional mascara or to seal mascara package 20 in preparation for storage.

Figure 12:
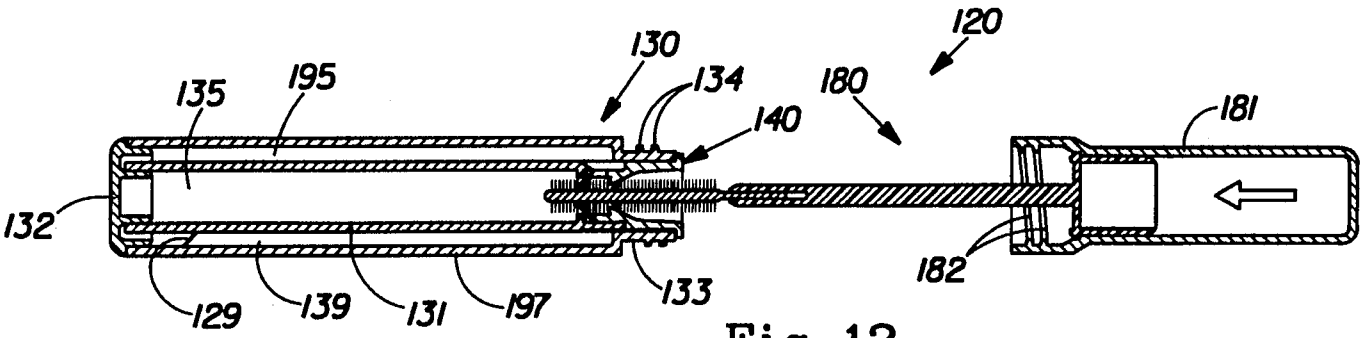
FIG. 12 is a cross-sectional view similar to FIG. 1 of an alternative embodiment of a mascara package of the present invention with the brush portion partially inserted into the bottle portion.

Referring to FIG. 12, an alternative embodiment of the present invention is provided in which cosmetic product package 120 comprises bottle portion 130 and brush portion 180. Brush portion 180 is virtually identical to brush portion 80 of the embodiment of FIGS. 1–11, previously described.

Bottle portion 130 includes inner bottle 131, outer bottle 197, and dual wiper mechanism 140. Inner bottle 131 and outer bottle 197 are coaxial and generally cylindrical in form and both are closed at one end having a common end plate 132. Inner bottle 131 has an open end opposite end plate 132 at neck 133. Neck 133 is provided with external threads 134 which are engageable with internal threads 182 on overcap 181 to releasably secure brush portion 180 to bottle portion 130. The interior of inner bottle 131 provides primary product reservoir 135. The space between the exterior of inner bottle 131 and the interior of outer bottle 197 generally defines discard product reservoir 195. Radial partitions 139 project inwardly from the interior of outer bottle 197 toward and engage the outer surface of inner bottle 131 to edges 129.

Figure 13:
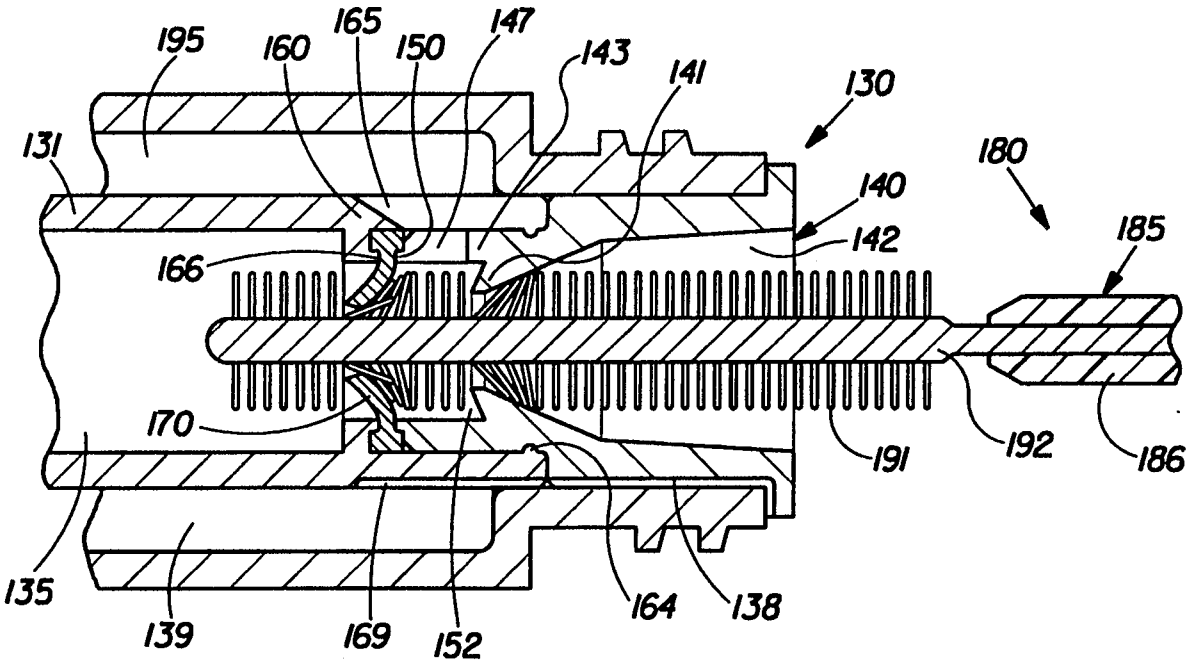
FIG. 13 is an enlarged fragmentary cross-sectional view similar to FIG. 2 of the alternative embodiment of the mascara package in FIG. 12 illustrating the dual wiper mechanism.

Referring to FIG. 13, wiper mechanism 140 includes housing 142, primary wiper 170, and primary wiper retainer 160. Housing 142 includes secondary wiper 141, inwardly extending cylindrical portion 143 which terminates in annular bead 150 and several radially spaced slots 147, similar to the previously described housing 42. In addition, housing 142 includes groove 138 which functions as a vent channel.

Primary wiper retainer 160 is generally similar to primary wiper retainer 60, including outwardly directed bead 166, lock bead 164 and radial slots 165. In addition, primary wiper retainer 160 includes an elongated cylindrical portion below primary wiper 170 which serves to bound inner bottle 131. Primary wiper retainer 160 also includes groove 169 which in combination with groove 138 functions as a vent channel for discard reservoir 195.

The operation of dual wiper mechanism 140 of mascara package 120 is generally similar to that described for dual wiper mechanism 40 of mascara package 20 with the important distinction that the residual mascara that accumulates in residual product reservoir 152 as brush portion 180 is reinserted into dual wiper mechanism 140 is diverted via the channel formed by the combination of radial slots 165 and 147 into discard product reservoir 195. Discard product reservoir 195 is isolated from primary product reservoir 135 so that mascara diverted into discard reservoir 195 is not available for further dispensing and application. As discard mascara flows into discard reservoir 195, air in discard reservoir 195 is displaced through vent channel created by grooves 169 and 138.

Figure 14:
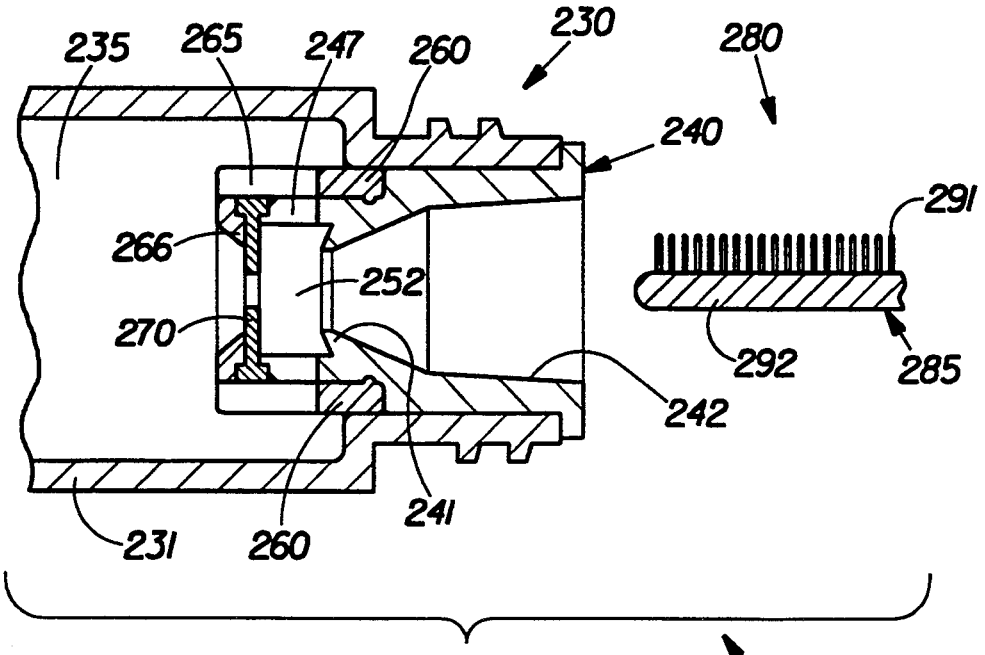
FIG. 14 is an enlarged fragmentary cross-sectional view similar to FIG. 2 of a second alternative embodiment of a mascara package of the present invention.
Figure 15:
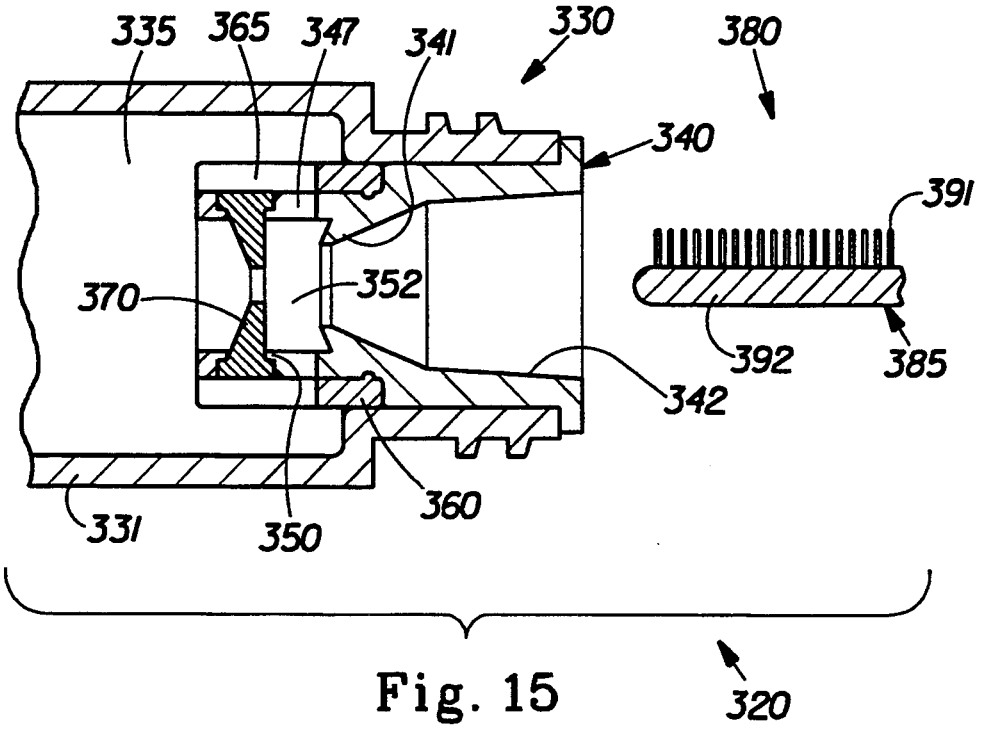
FIG. 15 is an enlarged fragmentary cross-sectional view similar to FIG. 2 of a third alternative embodiment of a mascara package of the present invention.

Referring to FIGS. 14 and 15, dual wiper mechanisms 240 and 340, respectively, include means for doctoring less product from the bristles 291 and 391, respectively as the brush portion 280 and 380, respectively is removed from the package 220 and 320, respectively than when the brush portion 280 and 380, respectively is returned to the package 220 and 320, respectively. Such a means may be advantageous, for example, with an embodiment including a discard product reservoir 195, such as that seen in FIGS. 12 and 13. As seen in FIG. 14, such a means is provided by elongating the annular bead portion 266 of primary wiper retainer 260 such that additional rigidity is provided to the primary wiper 270 as it is deformed toward the interior of the bottle 231. Thus, the primary wiper 270 deflects more readily as the stem 285 of brush portion 280 is removed from the bottle 231 than when the stem 285 of brush portion 280 is inserted into the bottle 231; thereby doctoring the bristles 291 more upon insertion of the stem 285 of brush portion 280 than upon removal.

As seen in FIG. 15, an alternative means is illustrated wherein the primary wiper 370 includes a conically shaped interior surface such that the primary wiper 370 resists deflection toward the interior of the bottle 331. Thus, the primary wiper 370 deflects more readily as the stem 385 of brush portion 380 is removed from the bottle 331 than when the stem 385 of brush portion 380 is inserted into the bottle 331; thereby doctoring the bristles 391 more upon insertion of the stem 385 brush portion 380 than above removal.

While particular embodiments of the present invention have been illustrated and described, it will be obvious to those skilled in the art that various changes and modifications can be made without departing from the spirit and scope of the present invention. Accordingly, the present invention comprises all embodiments within the scope of the appended claims.

What is claimed is:

1. A package for a cosmetic product comprising:

(a) a container having a plurality of walls connected so as to house the product, said container including an opening in one of the walls providing communication with the product housed within the container;

(b) a applicator including a stem having a proximal end, a distal end, means for grasping the applicator at the proximal end of the stem and means for applying the product at the distal end of the stem; and (c) a dual wiper mechanism located within the opening of the container including:

(i) a primary wiper element having an opening therein;

(ii) a secondary wiper element having an opening therein, the secondary wiper providing wiping of the stem; and (iii) a housing which locates the primary wiper element within the opening of the container and the secondary wiper element within the opening of the container exteriorly of the primary wiper element and spaced from the primary wiper element forming a residual cosmetic product reservoir between the primary wiper element and the secondary wiper element, the housing having a channel providing fluid communication from the residual product reservoir around the primary wiper element.

2. A package for a cosmetic product according to claim 1, wherein the opening in the primary wiper element has a diameter sufficiently small that no significant tail is left on the end of the stem as the applicator is removed from the container.

3. A package for a cosmetic product according to claim 2, wherein the diameter of the opening of the primary wiper is less than about the diameter of the distal end of the stem.

4. A package for a cosmetic product according to claim 1, wherein the primary wiper element includes a means for doctoring less product from the means for applying product as the applicator is removed from the container than as the applicator is returned to the container.

5. A package for a cosmetic product according to claim 2, wherein said means for applying the product is a plurality of bristles which form a brush.

6. A package for a cosmetic product according to claim 5, wherein said brush has bristles extending generally in at least one direction along the axis of the stem.

7. A package for a cosmetic product comprising:

(a) a container having a plurality of walls connected so as to house the product, said container including an opening in one of the walls providing communication with the product housed in a primary product reservoir within the container;

(b) an applicator including a stem having a diameter, a proximal end, a distal end, means for grasping the applicator at the proximal end of the stem and means for applying the product at the distal end of the stem; and (c) a dual wiper mechanism located within the opening of the container including:

(i) a primary wiper element having an opening therein with a diameter sufficiently small that no significant tail is left on the end of the stem as the applicator is removed from the container;

(ii) a secondary wiper element having an opening therein with a diameter approximately equal to the diameter of the applicator stem; and (iii) a housing which locates the primary wiper element within the opening of the container and the secondary wiper element within the opening of the container exteriorly of the primary wiper element and spaced from the primary wiper element forming a residual product reservoir between the primary wiper element and the secondary wiper element, the housing having a channel providing fluid communication from the residual product reservoir to the primary product reservoir, around the primary wiper element.

8. A package for a cosmetic product according to claim 7, wherein the diameter of the opening of the primary wiper is less than about the diameter of the distal end of the stem.

9. A package for a cosmetic product according to claim 7, wherein the primary wiper element includes a means for doctoring less product from the means for applying product as the applicator is removed from the container than as the applicatory is returned to the container.

10. A package for a cosmetic product according to claim 7, wherein said means for applying the product is a plurality of bristles which form a brush.

11. A package for a cosmetic product according to claim 10, wherein said brush has bristles extending generally in at least one direction along the axis of the stem.

12. A package for a cosmetic product comprising:

(a) a container having a plurality of walls connected so as to house the product in a primary product reservoir and in a separate discard product reservoir, said container including an opening in one of the walls providing communication with the primary product reservoir;

(b) an applicator including a stem having a proximal end, a distal end, means for grasping the applicator at the proximal end of the stem and means for applying the product at the distal end of the stem; and (c) a dual wiper mechanism located within the opening of the container including:

(i) a primary wiper element having an opening therein;

(ii) a secondary wiper element having an opening therein; and (iii) a housing which holds the primary wiper element within the opening of the container and the secondary wiper element within the opening of the container exteriorly of the primary wiper element and spaced from the primary wiper element forming a residual mascara reservoir between, the primary wiper element and the secondary wiper element, the housing having a channel providing fluid communication from the residual product reservoir to the discard product reservoir.

13. A package for a cosmetic product according to claim 12, wherein the opening in the primary wiper element has a diameter sufficiently small that no significant tail is left on the end of the stem as the applicator is removed from the container.

14. A package for a cosmetic product according to claim 13, wherein the diameter of the opening of the primary wiper is less than about the diameter of the distal end of the stem.

15. A package for a cosmetic product according to claim 12, wherein the primary wiper element includes a means for doctoring less product from the means for applying product as the applicator is returned to the container.

16. A package for a cosmetic product according to claim 13, wherein said means for applying the product is a plurality of bristles.

17. A package for a cosmetic product according to claim 16, wherein bristles extend generally in at least one direction along the axis of the stem.

* * * * *